United States Patent [19]

Morozumi

[11] Patent Number: 4,744,344

[45] Date of Patent: May 17, 1988

[54] SYSTEM FOR COMPENSATING AN OXYGEN SENSOR IN AN EMISSION CONTROL SYSTEM

[75] Inventor: Takuro Morozumi, Mitaka, Japan

[73] Assignee: Fuji Jukogyo Kabushiki Kaisha, Tokyo, Japan

[21] Appl. No.: 829,664

[22] Filed: Feb. 14, 1986

[30] Foreign Application Priority Data

Feb. 20, 1985 [JP] Japan ..... 60-33093
Feb. 27, 1985 [JP] Japan ..... 60-38500

[51] Int. Cl.[4] ..... F02M 7/24; F01N 3/22
[52] U.S. Cl. ..... 123/479; 123/440
[58] Field of Search ..... 123/489, 440, 479; 73/23

[56] References Cited

U.S. PATENT DOCUMENTS 4,121,548 10/1978 Hattori ..... 123/489
4,177,787 12/1979 Hattori ..... 123/489
4,364,227 12/1982 Yoshida ..... 123/440
4,502,444 3/1985 Rubbo ..... 123/440
4,558,677 12/1985 Hara ..... 123/440
4,603,670 8/1986 Bertsch ..... 123/440
4,612,892 9/1986 Iwanaga ..... 123/489
4,624,232 11/1986 Saito ..... 123/440

*Primary Examiner*—R. B. Cox
*Attorney, Agent, or Firm*—Martin A. Farber

[57] ABSTRACT

A system has an oxygen sensor, a proportion and integration circuit responsive to the output of the oxygen sensor for producing a PI signal at a constant of proportionality and a constant of integration and for controlling the air-fuel ratio of mixture to stoichiometry. The period of the output of the oxygen sensor is compared with a reference value by a comparator. When the period is longer than the reference value, the constants of proportionality and integration are changed so as to correct the deviation of the air-fuel ratio from stoichiometry.

14 Claims, 4 Drawing Sheets

SYSTEM FOR COMPENSATING AN OXYGEN SENSOR IN AN EMISSION CONTROL SYSTEM

BACKGROUND OF THE INVENTION

The present invention relates to a system for compensating the deterioration of an oxygen sensor in an emission control system for automotive engines.

An emission control system for an engine with a $ZrO_2$ oxygen sensor (called $O_2$-sensor hereinafter) is widely used. The system comprises proportion and integration circuit means responsive to the output of the $O_2$-sensor for producing a PI signal, and a driver for operating a fuel supply device such as a fuel injector in accordance with the PI signal so as to close the air-fuel ratio to stoichiometry. The output of the $O_2$-sensor varies cyclically in accordance with the periodic change of the air-fuel ratio of the mixture supplied to the cylinders of the engine.

On the other hand, the $O_2$-sensor gradually deteriorates over a period of time due to chemical and physical action caused by high temperature and components of the exhaust gases. When the $O_2$-sensor deteriorates, it produces its output with delay. As a result, the air-fuel ratio deviates from stoichiometry.

Japanese Patent Laid Open No. 54-12044 discloses a system for compensating the deterioration of the $O_2$-sensor. The system is adapted to detect the drop of the maximum output voltage and to compensate the delay of the output of the $O_2$-sensor in accordance with the maximum voltage. However, since the drop of the output voltage occurs when the $O_2$-sensor greatly deteriorates, exhaust gas purification is not carried out for a long time before the compensation.

SUMMARY OF THE INVENTION

The object of the present invention is to provide a system which may detect the deterioration of the $O_2$-sensor at an early stage and to compensate the deterioration.

When the $O_2$-sensor deteriorates, the period of the cycle of $O_2$-sensor output becomes longer than that of a normal $O_2$-sensor. The system of the present invention compares the period with a reference value so as to detect the deterioration. Thus, the deterioration can be detected at an early stage. In addition, when the $O_2$-sensor deteriorates, the air-fuel ratio deviates to the rich side from stoichiometry because the period from lean air-fuel ratio to rich is different from the period from rich to lean. In the system of the present invention, it operates to shift the air-fuel ratio to the lean side so as to close the air-fuel ratio to stoichiometry.

According to the present invention, there is provided a system for compensating an oxygen sensor in an emission control system for an automotive engine having a fuel supply device for supplying fuel to the engine cylinders, an oxygen sensor, a control circuit responsive to the output of the oxygen sensor for controlling the air-fuel ratio of the mixture to stoichiometry. The system comprises proportion and integration circuit means included in the control circuit for producing a PI signal at a constant of proportionality and a constant of integration, first means for detecting the steady state of the operation of the engine, second means for detecting the period of the output of the oxygen sensor at the steady state detected by the first means, a comparator for comparing the period detected by the second means with a predetermined reference value and for producing a difference signal when the period is longer than the reference value, and third means for changing the constants of proportionality and integration so as to correct the deviation of the air-fuel ratio from stoichiometry.

In an aspect of the present invention the first means comprises an engine speed sensor and a vacuum sensor for sensing the vacuum in an intake passage of the engine.

The other objects and features of this invention will become understood from the following description with reference to the accompanying drawings.

DETAILED DESCRIPTION OF THE PREFERRED EMBODIMENT

Figure 1A:
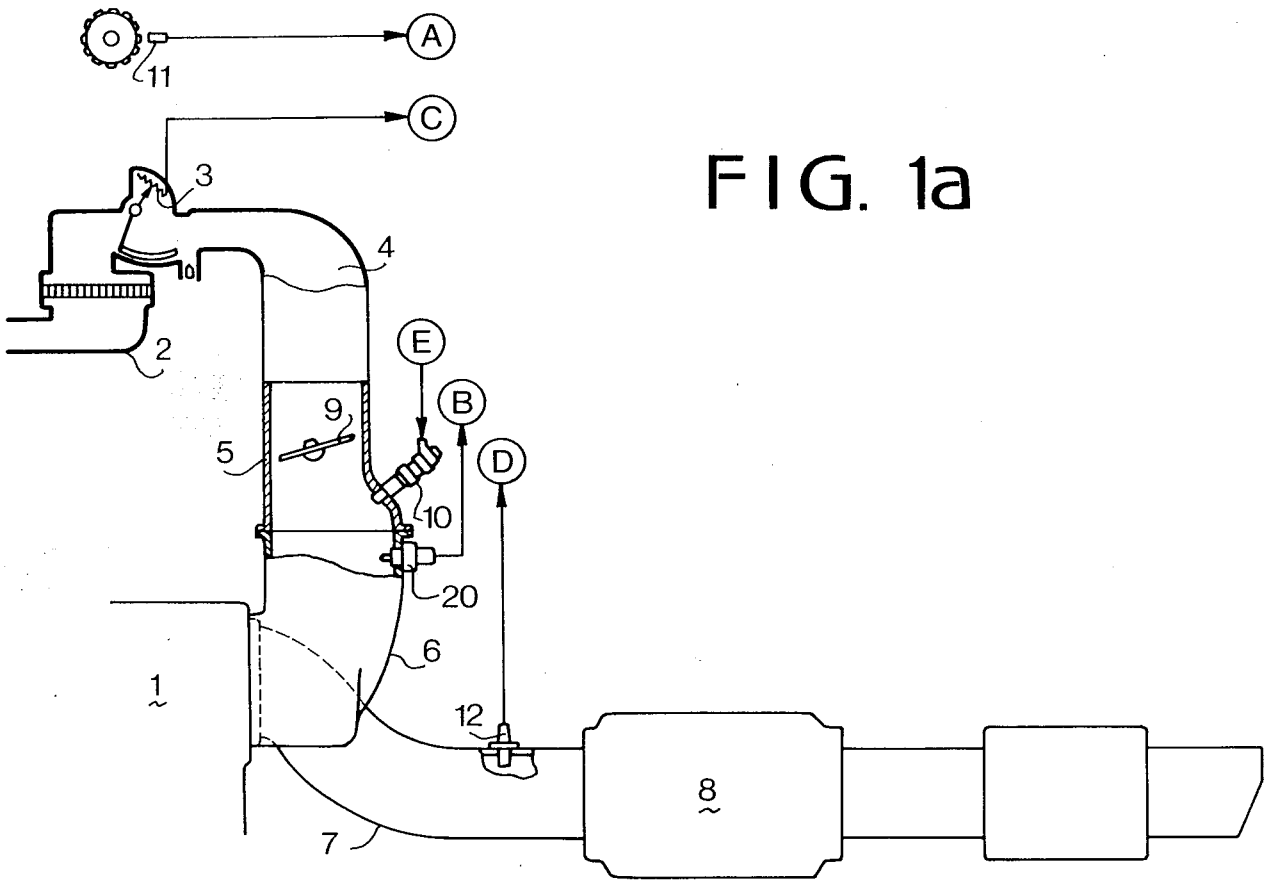
FIGS. 1*a* and 1*b* show a system of the present invention.
Figure 1B:
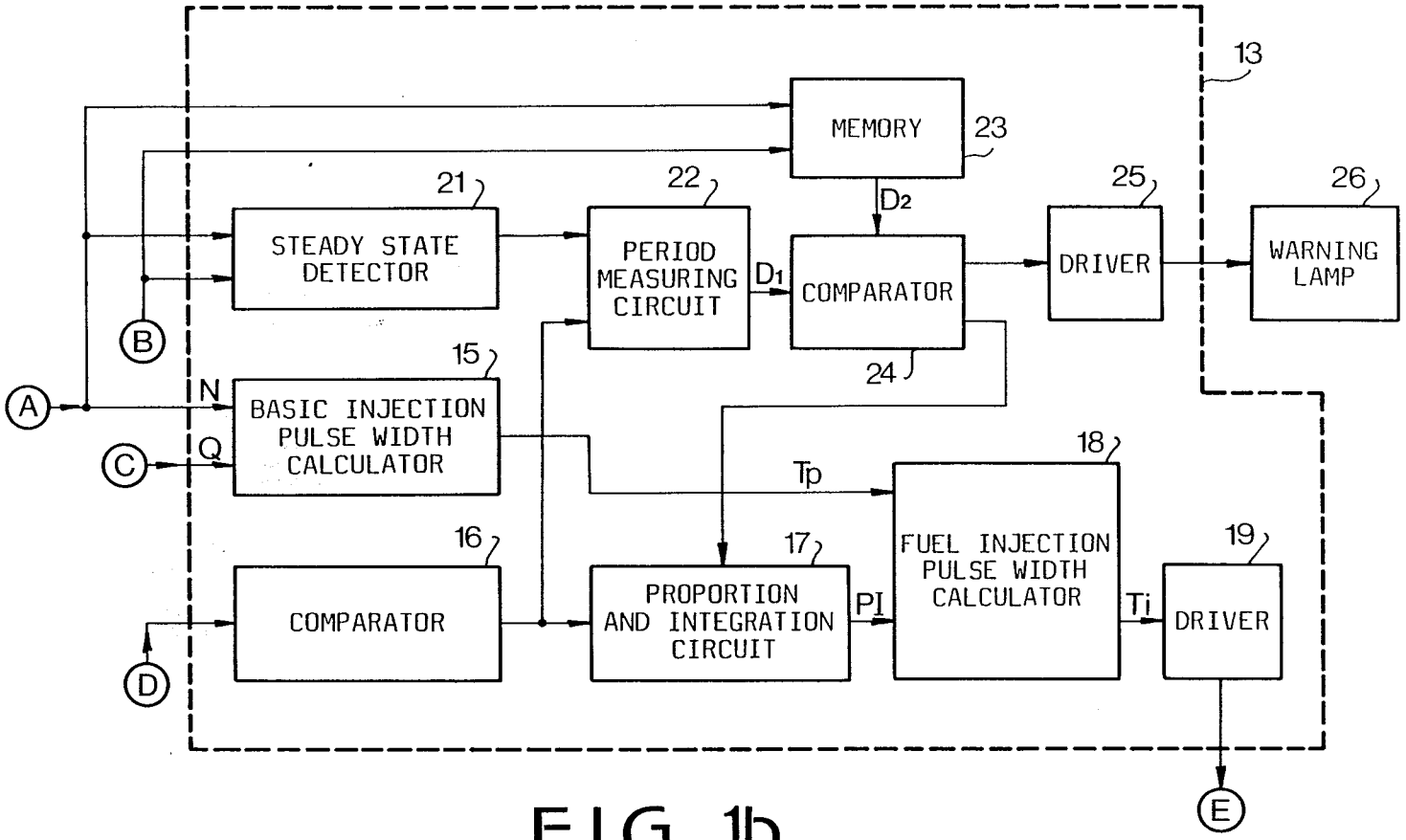

Referring to FIGS. 1*a* and 1*b*, an internal combustion engine 1 for a motor vehicle is provided with an air flow meter 3 in an intake pipe 4 downstream of an air cleaner 2, a throttle valve 9 in a throttle body 5 communicated with cylinders of the engine through an intake manifold 6, and a fuel injector 10. An engine speed sensor 11 is provided to measure the engine rpm and an $O_2$-sensor 12 is provided on an exhaust pipe 7 upstream of a three-way catalytic converter 8. A vacuum sensor 20 is provided on the intake manifold 6 downstream of the throttle valve 9 so as to detect load on the engine.

Output signal (N) of engine speed sensor 11 and output signal (Q) of the air flow meter 3 are applied to a basic injection pulse width calculator 15 in a control unit 13. The calculator 15 produces a basic fuel injection pulse width signal ($T_P$) based on engine speed (N) and the amount of intake air (Q). On the other hand, the output signal of $O_2$-sensor 12 is compared with a reference value by a comparator 16 to detect whether the air-fuel ratio of the mixture burned in the cylinders is rich or lean with respect to stoichiometry. Output voltage of the comparator 16 is applied to proportion and integration circuit means 17 where the output voltage is amplified and integrated at a constant of proportionality and a constant of integration (called PI constant hereinafter) to produce a PI signal (PI). The basic fuel injection pulse width signal $T_P$ and the PI signal PI are applied to a fuel injection pulse width calculator 18 which produces a fuel injection pulse signal ($T_i$) in accordance with the air-fuel ratio represented by the PI signal. The fuel injection pulse signal $T_i$ is applied to the fuel injector 10 through a driver 19. Thus, the air-fuel ratio is controlled to stoichiometry.

On the other hand, the output signal (N) of the engine speed sensor 11 and output signal of the vacuum sensor 20 are applied to a steady state detector 21 for detecting the steady state of the operation of the engine 1. The steady state detector 21 produces an output signal when engine operation continues for a predetermined time at a substantially constant speed and at a constant load. In response to the output signal of the detector 21, a period measuring circuit 22 measures the period of each cycle of the output signal of the $O_2$-sensor or measures the time between peak to peak of the output signal to produce a period signal ($D_1$) which is applied to a comparator 24.

Figure 3:
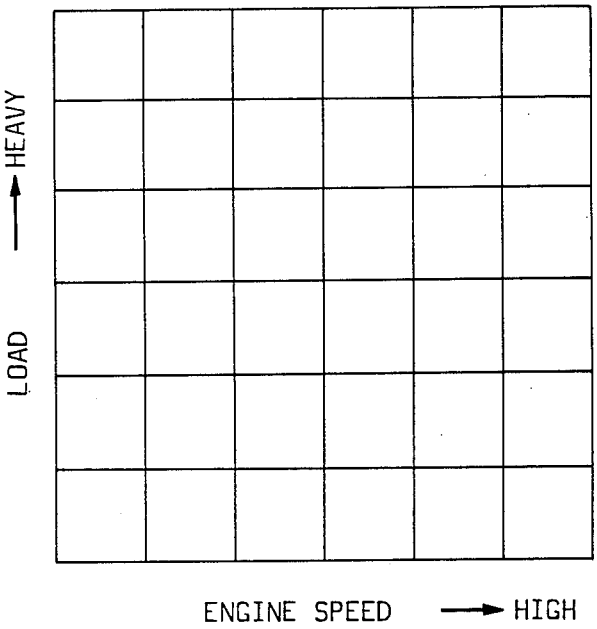
FIG. 3 shows a table for storing reference periods of an $O_2$-sensor.

The $O_2$-sensor has a certain output period with respect to engine speed and engine load. In the system of the present invention, a memory 23 having a table storing a reference period at every operating conditions is provided. As shown in FIG. 3, the table has a plurality of engine operating condition divisions divided by engine speed and engine load. In each division, a reference period is stored.

Figure 2:
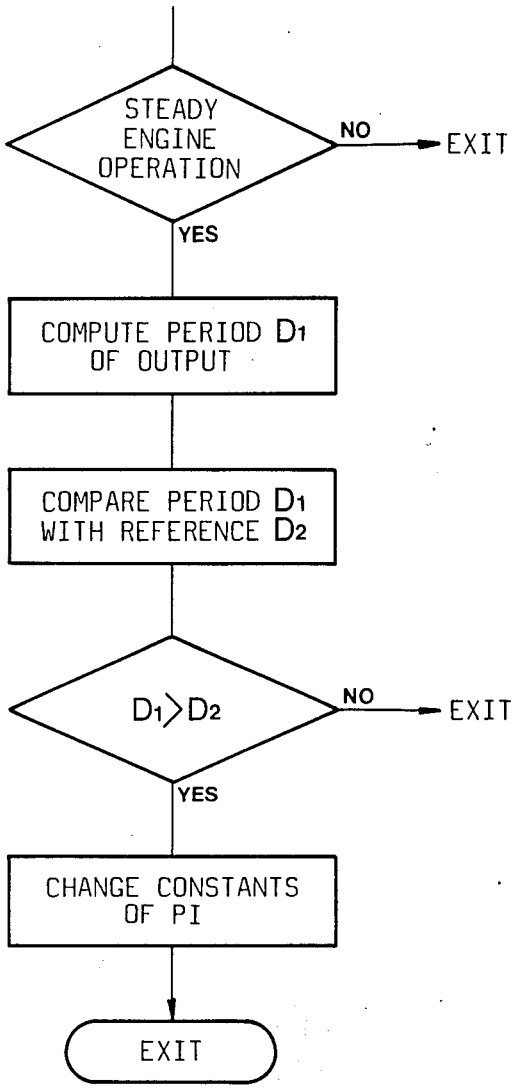
FIG. 2 is a flowchart showing the operation of the system.

In response to the output signals of the engine speed sensor 11 and vacuum sensor 20, the memory 23 produces a reference period signal ($D_2$) in a corresponding division of the table. The comparator 24 compares the period signal ($D_1$) with the reference period signal ($D_2$). In other words, actual engine driving conditions and the data of the memory 23 are compared in the same division of the table. The comparator 24 produces a difference signal when the actual period by signal ($D_1$) is longer than the reference period by signal ($D_2$). The more the $O_2$-sensor deteriorates, the longer the period by signal ($D_1$) becomes. The difference signal ($D_1$–$D_2$) is applied to the proportion and integration circuit means 17. The circuit means 17 operates to change the PI constant in accordance with the difference ($D_1$–$D_2$) so as to shift the air-fuel ratio, which is deviated to the rich side by the deterioration, to the lean side. Thus, the air-fuel ratio is converged to stoichiometry. FIG. 2 shows the above-described operation.

Further, the output of the comparator 24 is applied to a warning lamp 26 through a driver 25, thereby warning of the deterioration of the $O_2$-sensor.

Thus, in accordance with the present invention, the deterioration of the $O_2$-sensor can be detected at an early stage and the deviation of air-fuel ratio is corrected.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A system for compensating an oxygen sensor in an emission control system for an automotive engine having a fuel supply device for supplying fuel to cylinders, the oxygen sensor, a control circuit responsive to the output of the oxygen sensor for controlling the air-fuel ratio of mixture to stoichiometry, comprising;

proportion and integration circuit means included in the control circuit for producing a PI signal at a constant of proportionality and a constant of integration;

first means for detecting the steady state of the operation of the engine;

second means for detecting the period of the output of the oxygen sensor at the steady state detected by the first means;

a comparator for comparing the period detected by the second means with a predetermined reference value and for producing a difference signal when the period is longer than the reference value;

third means for changing the constants of proportionality and integration responsive to said difference signal so as to correct the deviation of the air-fuel ratio from the stoichiometry.

2. In an emission control unit for an automotive engine with cylinders, having a fuel supply device for supplying fuel mixing with air forming an air-fuel mixture to cylinders of the engine, an oxygen sensor of exhaust of the engine, and a control circuit responsive to the output of the oxygen sensor for controlling the fuel supply device so as to control the air-fuel ratio of the mixture to stoichiometry comprising proportion and integration circuit means for producing a PI signal at a constant of proportionality and a constant of integration, the improvement comprising a system for compensating for deterioration of the oxygen sensor, said system comprising first means for detecting steady state of operation of the engine;

second means for detecting a cyclic period between peak values of the output of the oxygen sensor at the steady state detected by the first means;

a comparator for comparing the period detected by the second means with a predetermined reference value and for producing a deterioration signal when the period is longer than the reference value;

third means for changing the constants of proportionality and integration in response to said deterioration signal so as to correct deviation of the air-fuel ratio from stoichiometry by said control circuit.

3. The system according to claim 1 wherein the first means comprises an engine speed sensor and a vacuum sensor for sensing the vacuum in an intake passage of the engine.

4. The system according to claim 2, further comprising memory means for providing the reference value from a plurality of references stored therein in a plurality of divisions in a form of a matrix classified by at least one engine operating condition, said memory means providing said reference value as the reference of said plurality of references corresponding to prevailing of the at least one engine operating condition.

5. The system according to claim 1 further comprising a warning lamp operated by the difference signal of the comparator.

6. The system according to claim 4, wherein said first means comprises: detection means for detecting said at least one prevailing operating condition; and means for determining the steady state operation of the engine when said at least one prevailing operating condition remains the same for a predetermined time, and said detection means is connected to said memory means.

7. The system according to claim 2, wherein said second means produces said deterioration signal as a difference signal having a value representing the difference between said period and said reference value, and said third means changes said constants dependent on the value of said difference signal.

8. The system according to claim 2, wherein said fuel supply device is a fuel injector of a fuel injection system, and said control circuit includes means for producing a fuel injection pulse signal, representing fuel injection pulse width, applied to said fuel injector and dependent on said constants.

9. The system according to claim 2, wherein said output of the oxygen sensor is a non-differentiated output of the oxygen sensor, of which non-differentiated output said second means detects the period thereof.

10. The system according to claim 1, wherein said output of the oxygen sensor is a non-differentiated output of the oxygen sensor, of which non-differentiated output said second means detects the period thereof.

11. The system according to claim 10, wherein said control circuit includes comparator means connected to said oxygen sensor and to said proportion and integration circuit means for comparing detected values of said oxygen sensor with a predetermined value representing stoichiometry for producing said non-differentiated output of said oxygen sensor of which said second means detects the period thereof.

12. The system according to claim 9, wherein said control circuit includes comparator means connected to said oxygen sensor and to said proportion and integration circuit means for comparing detected values of said oxygen sensor with a predetermined value representing stoichiometry for producing said non-differentiated output of said oxygen sensor of which said second means detects the period thereof.

13. The system according to claim 1, wherein said second means cyclically detects said period of the output of the oxygen sensor.

14. The system according to claim 1, further comprising memory means for providing the reference value from a plurality of references stored therein in a plurality of divisions in a form of a matrix classified by at least one engine operating condition, said memory means providing said reference value as the reference of said plurality of references corresponding to prevailing of the at least one engine operating condition.

* * * * *